US005661863A

United States Patent [19]

Tracy et al.

[11] Patent Number: 5,661,863

[45] Date of Patent: Sep. 2, 1997

[54] TOP REMOVING TOOL

[76] Inventors: Willard L. Tracy, 1000 N. Covell Apt. 8, Sioux Falls, S. Dak. 57104; Andrew Mouw, Sr., P.O. Box 6, Sibley, Iowa 51249

[21] Appl. No.: 585,947

[22] Filed: Jan. 16, 1996

[51] Int. Cl.[6] ..... B67B 7/00

[52] U.S. Cl. ..... 7/156; 30/443; 81/3.09

[58] Field of Search ..... 30/445, 443; 7/156; 81/3.09, 3.47, 3.55

[56] References Cited

U.S. PATENT DOCUMENTS 1,739,457 12/1929 Harrison ..... 7/156 X 1,741,294 12/1929 Halsey ..... 7/156 X 2,364,219 12/1944 Johnson ..... 30/443

FOREIGN PATENT DOCUMENTS 81854 3/1953 Norway ..... 7/156

*Primary Examiner*—James G. Smith

[57] ABSTRACT

A tool for opening cans having crimped overlying lids—specifically lids having perforated edges crimped over the open top of the can. The tool includes an edge adapted to cut open the perforated edges and a vane offset from the handle of the tool is adapted to raise the crimped edges to release the edges from the top of the can.

3 Claims, 1 Drawing Sheet

TOP REMOVING TOOL

BACKGROUND AND SUMMARY OF THE INVENTION

This invention pertains to tools for the opening of cans, particularly the larger cans such as 3-gallon, 5-gallon or larger cans in which liquid material is stored.

Most cans for liquid storage holding more than about a gallon or a gallon and a half are now closed by lids having peripheral edges crimped tightly over the upper edge of the can. These edges are often perforated by a series of holes spaced all around the periphery.

Opening these cans requires considerable force in raising the crimped edge of a fairly heavy metal lid. The initial sealing crimp may be applied by machines exerting substantial force. However, in the field, any machine for opening the can is frequently unavailable. Therefore, some other expedient is desirable.

Cans having tops with a continuous rim are particularly difficult to open because the stiffness of a continuous rim far exceeds that of a segmented rim. Thus, there is an obvious need for some means of leverage for opening such cans.

Present expedients may include screwdrivers, wrecking bars or the like to pry under the rim and use such leverage as may be available to spread the crimped edge of the lid. Such devices tend to slip from under the crimped edge and therefore to be inefficient in their operation.

By the present invention, a tool is provided which combines two functions. First it provides a cutting edge to cut the lid into a series of segments, thus resulting in a far less stiff edge to be spread. Second, a convenient lever is provided to pry open the segments or even an unsegmented lid.

DESCRIPTION

Figure 3:
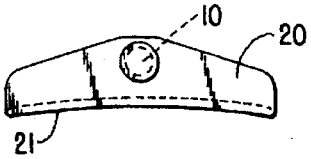
FIG. 3 is an end view from the handle end of the tool of FIG. 1.
Figure 1:
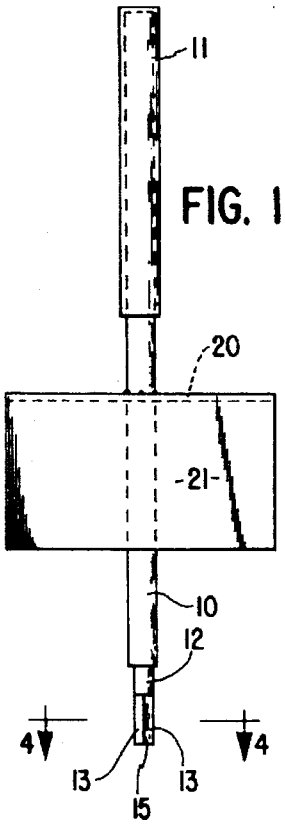
FIG. 1 is a plan view of the tool.

Briefly, this invention comprises a tool having a cutting edge adapted to cut the rim of a container top into segments and also to provide substantial leverage to the edge of the crimped top to open the crimping to allow removal of the top.

More specifically, and referring to the drawings, the tool comprises a body 10. This body may be in the form of a bar or a cylinder of considerable length in order to provide adequate leverage for the required purpose. A handle 11 may be provided as part of the body 10. The handle may be covered with a resilient material, if desired, or may simply be of a larger diameter than the rest of the body to provide less concentrated pressure on the hand of the user. Other forms of handle could also be used. For example, applicants have also used a handle formed of the same material as the body 10, but bent into a triangle.

Figure 4:
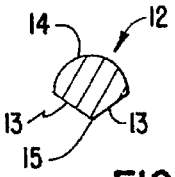
FIG. 4 is a sectional view from line 4—4 of FIG. 1.

At the end of the tool opposite the handle 11 is a hardened tip 12, having a cross section as shown in FIG. 4. As shown there, the cross section is basically circular except that a pair of flat sides 13 are cut from the arcuate periphery 14. In this way, a sharp edge 15 can be formed from the hardened metal of the tip.

Figure 2:
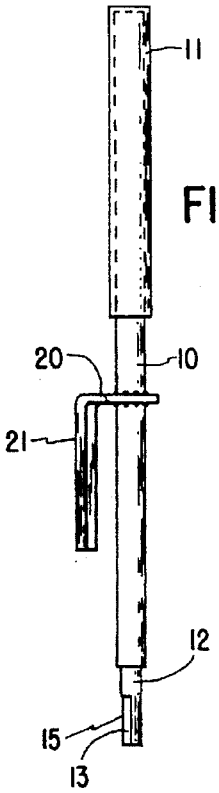
FIG. 2 is an edge view of the tool of FIG. 1.

On the shank of the body 10 a top-engaging flange is formed to provide easy engagement to open the crimping of the top. The flange blade 21 formed in arcuate shape as shown (FIG. 3) and having one end bent to form a right angle to the flange. The angular member 20 formed can encircle the body 10 and be fastened to the body by welding or the like to hold the blade 21 spaced from but substantially parallel to the body 10 as shown in FIGS. 2, 6 and 7.

Figure 5:
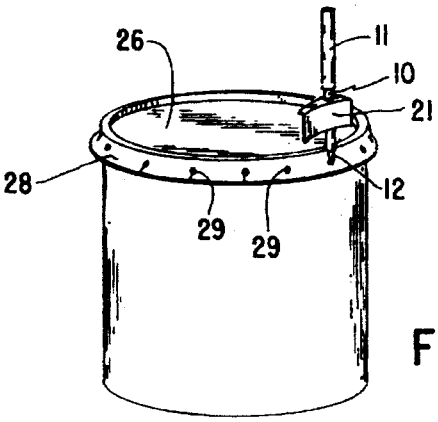
FIG. 5 is a view of the tool in use on a container for liquid.
Figure 6:
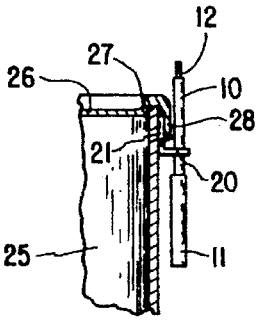
FIG. 6 is a detailed view showing the container section and the placement of the tool on the lid of the container.
Figure 7:
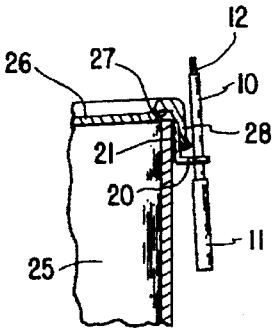
FIG. 7 is a view similar to FIG. 6 in a somewhat heavier container.

The use of the device is shown in FIGS. 5—7 of the drawing where it is shown in connection with a can 25. The top 26 is attached to the upper edge 27 of the can walls by means of a crimped rim 28 on the top 26. This rim 28, in present usage, often has a series of holes 29 punctured in the rim. Because the present tool is particularly useful in use with this type of rim, it is the one illustrated in FIG. 5. In that figure, the use of the tool at the start of the opening process is shown. The tip 12 of the tool is inserted into a hole 29 with the edge 15 facing the outer periphery of the rim 28. Then, as the handle 11 of this tool is forced toward the center of the top 26, there is considerable leveraged force on the edge of this hole 29. This tends to provide substantial force in a direction to do two things: a) to force the crimped rim 28 in a direction to relieve the crimping, and b) to cut through the metal of the rim 28 by means of the sharpened edge 15. The latter force may be the more desirable. If the edge 15 can be forced through the metal around the hole 29, the rim 28 will be cut into segments which can more readily be bent away from the can. Bent in either case, the rim 28 will tend to be moved to release the pressure that holds the top 26 onto the can 25.

The blade 21 may also be used for the purpose of relieving that pressure. Particularly where the edge 15 does cut the rim into segments, but also where the rim is left whole, the blade 21 can be inserted under the flanges of the rim 28, and the handle 11 pulled up and away from the can 25. Again, considerable leverage is available to increase the force available to pull the rim 28 away from the can 25 and to release the crimping pressure.

Thus, the present invention provides a relatively convenient tool for removing can lids which heretofore have caused minor problems for many people.

I claim as my invention:

1. A tool for removing a lid having a rim crimped onto a can, said rim being formed with a series of holes therein, said tool comprising a bar member having a handle and a tip; said tip having a substantially cylindrical cross section with a longitudinally extending cutting edge; said tip adapted to be inserted into any of said holes and then moved over said lid to cut through said holes as said tool is pivoted toward a center of said lid; an arcuate flange secured intermediate said handle and said tip whereby said flange engages an underside of said rim to remove said lid by a prying action.

2. The tool of claim 1 in which said flange includes a blade held in spaced relation to said bar member, said blade being engageable with said underside of said rim.

3. The tool of claim 2 in which said blade includes an angular member at approximately 90 degrees to said blade, said angular member being fixed to said bar member whereby said spaced relation is maintained.

* * * * *